US005524881A

United States Patent [19]

Edward

[11] Patent Number: 5,524,881

[45] Date of Patent: Jun. 11, 1996

[54] BASKETBALL TRAINING APPARATUS

[76] Inventor: Ricardo E. Edward, 20030 NW. 3rd Ct., Miami, Fla. 33169

[21] Appl. No.: 437,689

[22] Filed: May 9, 1995

Related U.S. Application Data

[63] Continuation-in-part of Ser. No. 193,389, Feb. 8, 1994, abandoned.

[51] Int. Cl.[6] ..... A63B 63/08

[52] U.S. Cl. ..... 273/1.5 A; 273/1.5 R; 273/400; 403/225; 403/372

[58] Field of Search ..... 273/1.5 R, 1.5 A, 273/350, 402, 400; 248/97, 150, 159; 403/361, 372, 226, 225

[56] References Cited

U.S. PATENT DOCUMENTS

| | | | |
|---|---|---|---|
| 1,542,164 | 6/1925 | Nelson | 248/97 |
| 1,817,774 | 8/1931 | Sipe | 403/225 X |
| 2,785,453 | 3/1957 | Wentz | 403/372 X |
| 3,134,594 | 5/1964 | Crowley | 273/1.5 X |
| 4,157,801 | 6/1979 | Elmer | 248/97 |
| 4,543,695 | 10/1985 | Dorsey | 403/372 X |
| 4,595,199 | 6/1986 | Offutt | 273/1.5 A |
| 4,705,246 | 11/1987 | Wolf | 248/97 |
| 4,786,053 | 11/1988 | Barnes, Jr. | 273/1.5 R |
| 4,810,031 | 3/1989 | Patterson | 248/97 X |

OTHER PUBLICATIONS

Playthings, Jul.–1964, vol. 62 #7, p. 168, Water Basketball Set.

Toys to Grow on Fall 1988, Oct.–1988, p. 7, 4–Foot Tall Basketball Hoop.

*Primary Examiner*—Paul E. Shapiro

[57] ABSTRACT

A basketball training apparatus for practicing "outside shooting" and including a rim and attached net supported by a supporting frame structure so that the rim is maintained in a horizontal orientation at a regulation height above the floor and in a manner unobstructed by the supporting structure so as to simulate the reaction to ball impact and the appearance of a conventionally supported basketball rim. The supporting frame structure includes individual frame members and frame connectors for attaching the frame members at opposite ends to define a base and upwardly extending legs attachable to connecting elements on the rim. The connecting elements each include a cup having an open end adapted to receive an upper end zone of the legs therein and a rod extension of reduced diameter interconnecting between the cup and the rim and structured to support and maintain the rim in spaced, unobstructed relation above the cups and frame structure. A trap net attaches between the legs from the base up to the rim for capturing basketballs shot through the rim or to return missed shot attempts which fall short of the rim.

5 Claims, 2 Drawing Sheets

BASKETBALL TRAINING APPARATUS

This application is a continuation-in-part application of patent application Ser. No. 08/193,389 filed Feb. 8, 1994 now abandoned.

BACKGROUND OF THE INVENTION

1. Field of the Invention

The present invention is directed to a basketball training device for practicing "outside shooting." More specifically, the present invention is directed to a basketball rim and supporting apparatus which eliminates the use of a conventional backboard as normally used in combination with a basketball hoop or rim, such that shots can be attempted from 360 degrees about the rim.

2. Description of the Related Art

In order to play basketball, a player must develop various fundamental skills. One of the fundamental skills is the ability to shoot the basketball through the rim or goal without the assistance of the backboard. This ability to shoot for the basket is especially important when attempting a baseline shot or outside shot in which the use of the backboard is generally avoided. Therefore, it is important for a player to develop an ability to focus on the direction, trajectory and velocity of the basketball so that accurate shots from distances between 5–25 feet can be consistently made at the basket.

Currently, there does not exist a basketball training device which eliminates the backboard in the manner of the present invention. Some of the training devices currently available include those disclosed in U.S. Pat. No. 5,163,845 to Blassingame directed to a portable free standing visual aid and U.S. Pat. No. 5,039,997 to Mele, directed to a multifunctional basketball game monitoring unit. More sophisticated devices include feedback enhanced learning devices as disclosed in U.S. Pat. No. 4,565,527 to Burchett which focuses on a method and apparatus for training a human by feedback enhanced learning. The device allows a player to use 2 beams of light and alarm signals to let the player know that the path of the ball has somehow been deflected. The device delineates the process needed for enhancing free throw shooting.

The present invention is specifically designed to permit a player to focus on his/her overall outside shooting. This is done by forcing the player to focus on the basketball rim, as there is never a backboard positioned behind the rim. Accordingly, the player is forced to focus on the direction, trajectory and velocity of the basketball. By not having a backboard, the player, by applying these three parameters at any given distance and at a full liberty of having a 360 degree view of the rim, is able to attempt flush shots directly through the rim, thereby strengthening the player's overall outside shooting ability.

The following design patents disclose designs for basketball game devices; U.S. Pat. No. Des. 110,225 to Schutt for a play ball goal, U.S. Pat. No. Des. 264,740 to Merino, et al. for a water basketball game goal and U.S. Pat. No. Des. 277,884 to Offutt for a game ball goal. While the various devices disclosed in these patents eliminate backboards, they are not directed to a regulation basketball apparatus, but, rather they are basketball games such as those used in a swimming pool. Furthermore, these devices do not support the rim in a manner which simulates both the reaction to impact of the ball with the rim as well as the appearance of the rim; being supported in spaced, unobstructed relation above the supporting frame structure.

OBJECTS AND ADVANTAGES OF THE INVENTION

Besides the objects and advantages briefly described above, several objects and advantages of the present invention include:

(a) ease of assembly and disassembly;

(b) maneuverability ease (people of ages 11 years and older can easily handle assembly, disassembly and movement of the apparatus);

(c) strengthens the outside or perimeter shooting skill for playing the sport of basketball;

(d) improves the aiming ability at the basketball rim or goal using the three parameters set forth in the above description;

(e) strengthens the eye focus on the rim and coordination when shooting a basketball;

(f) the frame structure and trap net act to serve as a ball trap and/or ball return once shots are made or missed.

Still further objects and advantages will become more readily apparent from the following description and drawings.

SUMMARY OF THE INVENTION

The present invention is directed to a basketball training apparatus, being specifically designed to develop and/or improve shooting skills, and particularly outside shooting accuracy. It is, therefore, important to duplicate the true feel that one gets when successfully "scoring" (making) a shot, that being: accuracy, shooting the ball in the direction of the basket; shooting the ball with the proper trajectory; and letting the ball go with sufficient touch and velocity to actually reach the goal (through the rim). If the rim is not stable, or if it is held too rigidly, the ball will not react the same when hitting the rim as with a conventional basketball goal. In this instance, a player practicing will not acquire the right "feel" as he/she would experience when shooting at a conventional basketball goal. Of particular importance is maintaining visibility of the rim in a manner which simulates the appearance of a conventionally supported basketball rim. Further, it is important that the rim be rigidly supported, yet allowing the rim to simulate the reverberating effect produced by the ball making contact with the rim.

In accordance with the present invention, there is provided a rim supported by a supporting frame structure so that the rim is maintained in a horizontal orientation at a regulation height above the floor and in a manner unobstructed by the supporting structure so as to simulate the reaction to ball impact and the appearance of a conventionally supported basketball rim. An important feature of the present invention is connecting elements for removably attaching the rim to the supporting frame structure. The connecting elements each include a cup having an open end and adapted to receive an upper end zone of legs of the supporting frame structure. A rod extension of reduced diameter interconnects between the cup and the rim in a manner so as to support and maintain the rim in spaced, unobstructed relation above the cups and frame structure, thereby promoting visibility of the rim and further simulating the reaction of the rim to impact with a basketball. In this regard, the rod extensions between the cups and the rim act as a stabilizer means, absorbing some of the impact from basketballs hitting the rim and simulating the reverberation effect which results when a basketball hits a conventionally supported basketball rim.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
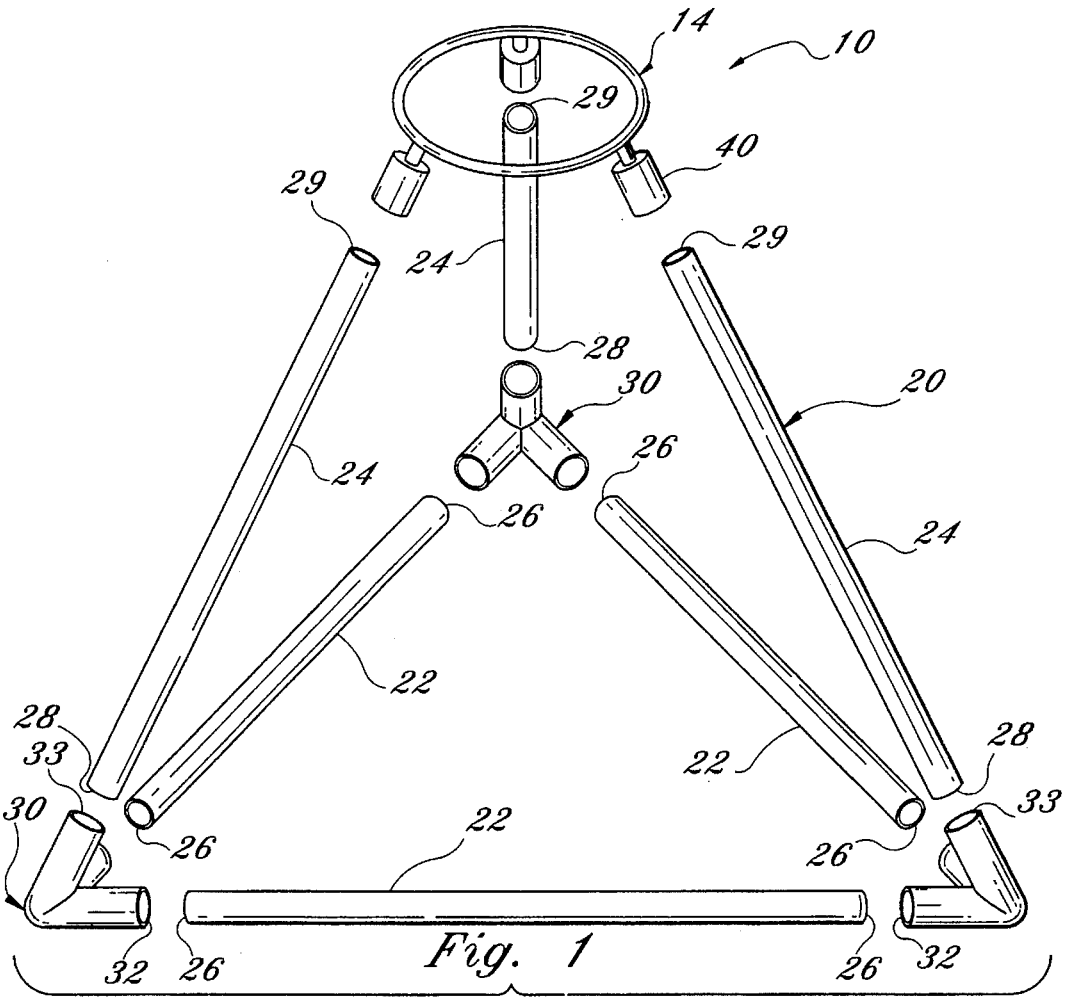
FIG. 1 is an exploded view, shown in perspective, of a preferred embodiment of the basketball training apparatus of the present invention.
Figure 2:
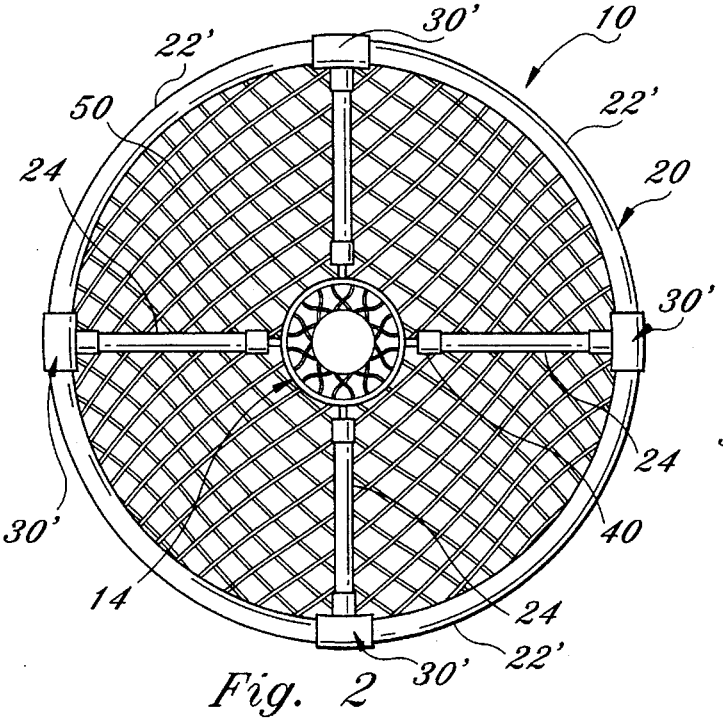
FIG. 2 is a top plan view of another preferred embodiment of the present invention including a circular base.
Figure 3:
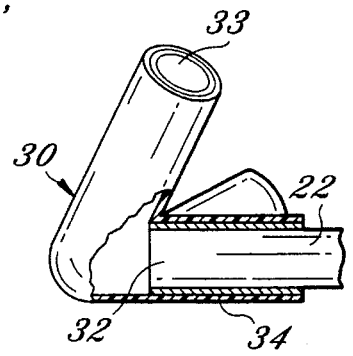
FIG. 3 is an isolated view, in partial section, illustrating a frame connector of the present invention.
Figure 5:
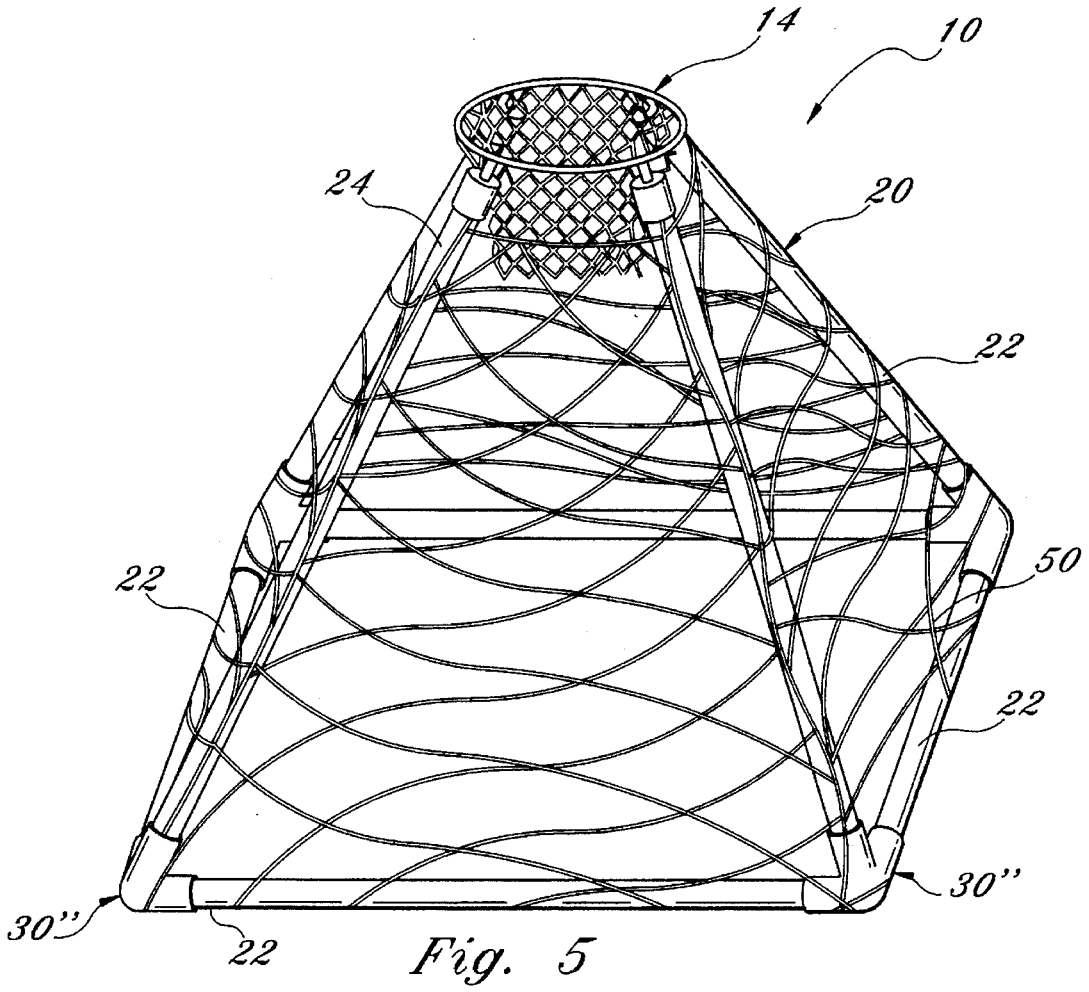
FIG. 5 is a perspective view of still another preferred embodiment of the present invention including a square base.
Figure 4:
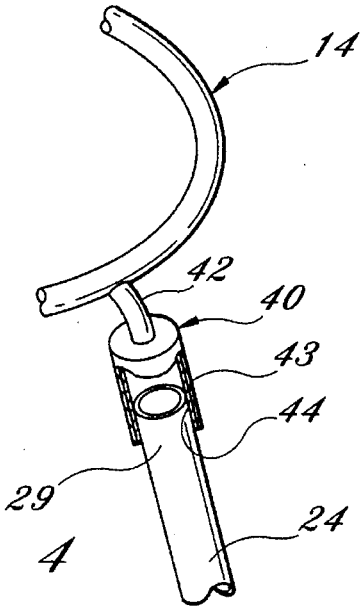
FIG. 4 is an isolated view, in partial section, illustrating a connector element on the rim for connecting the rim to the frame structure of the present invention.

Referring to the several views of the drawings, and initially FIG. 1, there is generally illustrated the basketball training apparatus 10 of the present invention. In each of the various embodiments of the present invention, the apparatus 10 includes a rim 14, defining a basketball goal, which may further include a conventional net, as seen in FIGS. 2 and 5. The basketball rim is structured for attachment to a supporting frame structure in such a manner that the rim is maintained in a horizontal orientation at a regulation height above the floor in spaced, unobstructed relation above the supporting frame structure. In this manner, the rim is clearly visible from all directions relative to the supporting frame, thereby simulating the appearance of a conventional rim and enabling the user to better focus on the rim.

The frame structure 20 includes a plurality of individual frame members including base frame members 22 and leg members 24. Each of the base frame members 22 are of equal length and include opposite ends 26. The base frame members 22 may be straight or, alternatively, may be arced or curved so that when interconnected at their opposite ends they form a circular base as seen in FIG. 2.

The leg members 24 are preferably straight and of equal, predetermined length so as to support the rim 14 at a desired regulation height. The leg members 24 each include a first lower end 28 and an opposite second end 29.

To facilitate interconnection of the frame members to instruct the frame structure 20, a plurality of frame connectors 30 are provided. In each of the various embodiments shown throughout the several views of the drawings, the frame connectors 30, 30', 30" each include three connection ports including two base connection ports 32 and a leg connection port 33. Within each of the connection ports there is a sleeve defining a friction bearing 34 which is specifically structured and configured for releasable frictional engagement with an end zone of the base frame member or, the leg member, respectively. The leg connection port 33 is specifically angled relative to the base connections ports 32 so that a leg member 24 attached therein is angled upwardly at a predetermined angle relative to the underlying floor surface. In this manner, when all of the frame members of the frame structure 20 are interconnected, the upper ends 29 of the leg members 24 are disposed in equally spaced relation to one another at the same height relative to the underlying floor surface.

In a first preferred embodiment, as seen in FIG. 1, the base connecting ports 32 and leg connecting port 33 of each of the frame connectors 30 are angled relative to one another so as to angle the various frame members relative to one another in a manner so as to form an overall pyramid shape to the frame structure 20. In another embodiment, as shown in FIG. 2, the base frame members 22' are arced with the frame connectors 30' being specifically structured for interconnection of the opposite ends of the base frame members and leg members 24.

In still another embodiment, as shown in FIG. 5, the frame connectors 30" are specifically structured and configured so that the base frame members 22, once interconnected at their opposite ends 25, form a square base.

The rim 14 is provided with interconnection means 40 for interconnecting the rim 14 to the ends 29 of the leg members. The interconnection means 40 is generally, in a preferred embodiment, in the shape of a cup having a first end attached to the rim by a short rod 42. An open end of the cup and a surrounding wall 43 are sized and configured for receipt of the leg member 24 therein. The short rod 42 is of a reduced diameter relative to the cup and is structured to rigidly support the rim 14 above the cups and leg members so as to promote visibility of the rim and to prevent interference of the cups with a ball striking the rim. The inner surface of the wall 43 includes a friction bearing 44, similar to that in e connection ports of the frame connectors 30, structured for frictional, releasable engagement with the upper end 29 of the leg members 24. Once attached, the rim 14 is oriented in a horizontal position such that a vertical central axis through the center of the rim 14 is perpendicular to the underlying floor surface, much the same as a traditional basketball goal.

In order to prevent basketballs from scattering from e practice area, a trap net 50 may be attached about the frame structure 20 between each of the leg members 24 from the base frame members 22 up to the rim 14. Thus, when a successful shot is made and the basketball passes through the rim 14, the ball will be trapped within the frame structure 20. Additionally, if a shot attempt falls short of the rim 14, the trap net 50 will serve to catch the basketball and rebound the ball in the general direction of the shooter.

While the present invention has been shown and described in what is considered preferred embodiments, it is recognized that departures may be made within the spirit and scope of the invention, which should not therefore be limited except by the following claims and within the Doctrine of Equivalents.

Now that the invention has been described,

What is claimed is:

1. A basketball training apparatus comprising:

a frame structure including a plurality of thin-wall tubular frame members, said plurality of frame members including a plurality of base frame members adapted for interconnection at opposite ends to define a base, and a plurality of leg members each including a lower distal end zone, connector means for removably interconnecting said base frame members at said opposite ends to define said base, said connector means being further structured for removably interconnecting said lower distal end zone of each of said leg members to said base, said connector means including a plurality of connector elements each having three connection ports, said ports including two base connection ports structured for fitted attachment onto said opposite ends of said base frame members and a leg connection port structured for fitted attachment onto said lower distal end zone of said leg members, said leg connection port being disposed in angular relation to said base connection ports so that said leg members are supported in an upwardly angled position relative to said base and underlying floor surface with said respective upper distal end zones disposed in equally spaced relation to one another at the same height above the base, said ports further including a sleeve having a friction bearing therein structured for releaseable, frictional engagement with a respective one of said opposite ends of said base frame members and said lower distal end zones of a respective one of said leg members, a circular rim having a maximum cross sectional dimension defining a basketball goal including means for releaseable interconnection to each of said respective upper distal end zones of said leg members such that said circular rim is fixedly supported in a horizontal position at a predetermined height above said base, said leg members having a minimum cross section dimension at least three times the maximum cross sectional dimension of said rim, said rim interconnection means including a plurality of cup-shaped members each structured and disposed for fitted attachment onto a respective one of said upper distal end zones of said leg members, each of said cup-shaped members including a bottom end, an open end, and a surrounding wall having an inner surface, said inner surface including a friction bearing structured for releaseable, frictional engagement with said upper distal end zone of a respective one of said leg members, said rim interconnection means further including a rod extending and interconnecting between said bottom end of each of said cup-shaped members and said rim, said rod having a maximum cross sectional dimension no greater than the maximum cross sectional dimension of said rim and being of a reduced diameter relative to said surrounding wall of said cup-shaped members and being structured and disposed to support said rim in spaced, unobstructed relation above said cup-shaped members and said leg members so as to avoid a ball striking said rim from simultaneously contacting said cup-shaped members or said leg members and further promoting visibility of said rim relatively to a remainder of said apparatus, and a trap net having a mesh construction and being attachable to said frame structure so as to extend between each of said leg members and from said base members to said rim.

2. An apparatus as recited in claim 1 wherein each of said base frame members are of equal length.

3. An apparatus as recited in claim 2 wherein each of said base frame members are straight.

4. An apparatus as recited in claim 2 wherein each of said base frame members are curved.

5. An apparatus as recited in claim 4 wherein each of said base frame members are curved about an arc of 90 degrees.

* * * * *